US008464615B2

(12) United States Patent
Streater et al.

(10) Patent No.: US 8,464,615 B2
(45) Date of Patent: Jun. 18, 2013

(54) SAFETY PIPE WRENCH

(75) Inventors: James Robert Streater, Humble, TX (US); Jeffery Ronald Clausen, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 383 days.

(21) Appl. No.: 12/748,509

(22) Filed: Mar. 29, 2010

(65) Prior Publication Data

US 2011/0232427 A1 Sep. 29, 2011

(51) Int. Cl.
*B25B 13/16* (2006.01)
*B25B 23/16* (2006.01)
*B25B 13/58* (2006.01)

(52) U.S. Cl.
USPC ..... 81/167; 81/185.1; 81/177.1

(58) Field of Classification Search
USPC ..... 81/165, 167, 92, 177.1, 185.1, 186, 81/100, 101
See application file for complete search history.

(56) References Cited

U.S. PATENT DOCUMENTS

| | | | | | |
|---|---|---|---|---|---|
| 50,748 | A | * | 10/1865 | Stillson et al. | 81/97 |
| 494,529 | A | * | 3/1893 | Jenks | 81/167 |
| 603,084 | A | * | 4/1898 | Higgins | 7/139 |
| 1,395,952 | A | * | 11/1921 | Fraro | 81/97 |
| 1,885,605 | A | * | 11/1932 | Kightlinger | 81/91.3 |
| 2,558,897 | A | * | 7/1951 | Akins | 81/57.31 |
| 2,633,045 | A | | 3/1953 | Lurie | 81/179 |
| 2,656,751 | A | | 10/1953 | Johnson et al. | 81/186 |
| 2,680,984 | A | | 6/1954 | Ingwer | 81/101 |
| 3,985,050 | A | | 10/1976 | Lurie | |
| 4,561,330 | A | | 12/1985 | Chen | 81/129.5 |
| 4,580,468 | A | | 4/1986 | Cox | 81/138 |
| 4,712,455 | A | | 12/1987 | Cox | |
| 4,924,735 | A | | 5/1990 | Lee | 81/133 |
| 6,089,130 | A | * | 7/2000 | Wu | 81/177.1 |
| 6,962,099 | B2 | | 11/2005 | Slepekis | |
| 2004/0129115 | A1 | | 7/2004 | Gregory | |
| 2005/0044999 | A1 | | 3/2005 | Slepekis | 81/157 |

FOREIGN PATENT DOCUMENTS

| | | |
|---|---|---|
| CN | 2732425 | 10/2005 |
| CN | 2732425 Y | 10/2005 |
| GB | 189395 | 11/1922 |
| GB | 706990 | 4/1954 |
| KR | 20-1993-0013392 | 7/1993 |

OTHER PUBLICATIONS

International Search Report and Written Opinion for PCT/US2011/030156, mailed Nov. 30, 2011.
International Preliminary Report on Patentability from counterpart PCT Patent Application No. PCT/US2011/030156, Oct. 2, 2012, 6 pages.

* cited by examiner

*Primary Examiner* — Hadi Shakeri
(74) *Attorney, Agent, or Firm* — Jeffery E. Daly; The JL Salazar Law Firm

(57) ABSTRACT

A safety pipe wrench includes a Y-shaped handle having a stem extending from a first end of the handle towards a second end of the handle. The stem bifurcates into a first arm and a second arm at a location between the first end and the second end of the handle. The first arm and the second arm extend to the second end of the handle. A slot is defined between the first arm and the second arm. A first gripping insert is mounted on the first arm. A nut is rotatably retained in the slot. A jaw has a shank terminating in a jaw head. The shank is movably engaged with the nut. A second gripping insert is mounted on the jaw head.

23 Claims, 3 Drawing Sheets

SAFETY PIPE WRENCH

TECHNICAL FIELD

The invention relates generally to sliding-jaw pipe wrenches.

BACKGROUND

Lightweight, sliding-jaw, pipe wrenches are described in, for example, U.S. Pat. No. 2,656,751 (issued to W. J. Johnson et al.) and U.S. Pat. No. 2,680,984 (issued to C. H. Ingwer). FIG. 1 shows a lightweight, sliding-jaw pipe wrench from U.S. Pat. No. 2,656,751 (the '751 patent). The pipe wrench of FIG. 1 consists of a handle 10 having a fixed jaw 11 and an integral frame 12 through which extends a threaded shank 13 of a movable jaw 14, which is adjustable relative to the jaw 11 by a nut 15 engaging the shank 13 and supported and retained between the frame 12 and a pair of bosses 16. The jaws 11 and 14 are provided with replaceable jaw inserts 17 and 18, respectively. The '751 patent describes the pipe wrench as being formed essentially of a metal or alloy that is lightweight and that does not have as high a yield point under proof as malleable iron and steel. The '751 patent describes designing and proportioning various elements of the pipe wrench to compensate for the low yield point of the lightweight material. For example, as disclosed in the '751 patent, the handle 10 has an H transverse cross-section.

Pipe wrenches such as described above are available in the market. For example, the Rigid Tool Company makes a variety of such pipe wrenches under the trade name RIDGID®. Lightweight, sliding-jaw, pipe wrenches such as described above are commonly used in downhole tool service facilities to apply high connection makeup torques. Typically, these wrenches are attached to an overhead crane when being used. Safety has been a concern with these wrenches when operating at high torque loads. Bent handles and fractured jaws are a common occurrence for such wrenches, which can result in jaws becoming air borne, handles swinging free violently, and overhead cranes being shocked and potentially damaged.

SUMMARY

One aspect of the present invention relates to a safety pipe wrench. The safety pipe wrench comprises a Y-shaped handle having a stem extending from a first end of the handle towards a second end of the handle. The stem bifurcates into a first arm and a second arm at a location between the first end and the second of the handle. The first arm and the second extend to the second end of the handle. A slot is defined between the first arm and the second arm. The safety pipe wrench comprises a first gripping insert mounted on the first arm. The safety pipe wrench comprises a nut rotatably retained in the slot. The safety pipe wrench comprises a jaw having a shank terminating in a jaw head. The shank is movably engaged with the nut. The safety pipe wrench comprises a second gripping insert mounted on the jaw head.

Additional aspects of the present invention will be apparent from the following detailed description and the appended claims.

BRIEF DESCRIPTION OF DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
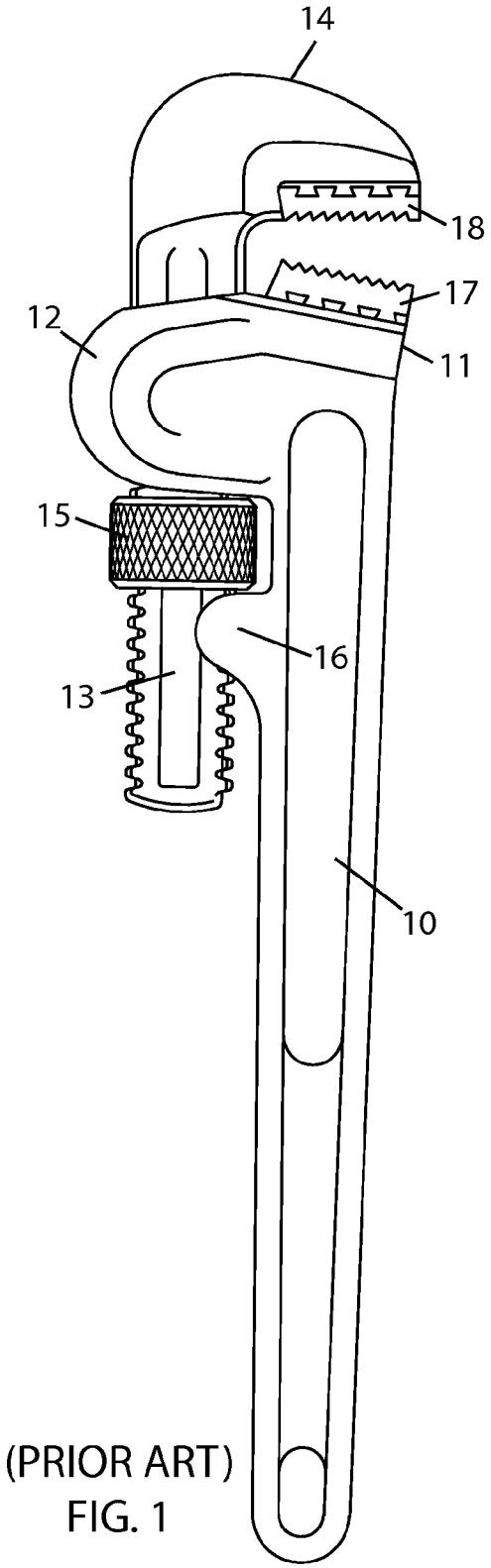
(PRIOR ART) FIG. 1
FIG. 1 is a side view of a prior-art pipe wrench.

In the following detailed description, numerous specific details may be set forth in order to provide a thorough understanding of embodiments of the invention. However, it will be clear to one skilled in the art when embodiments of the invention may be practiced without some or all of these specific details. In other instances, well-known features or processes may not be described in detail so as not to unnecessarily obscure the invention. In addition, similar or identical reference numerals may be used to identify similar or common elements.

Figure 2:
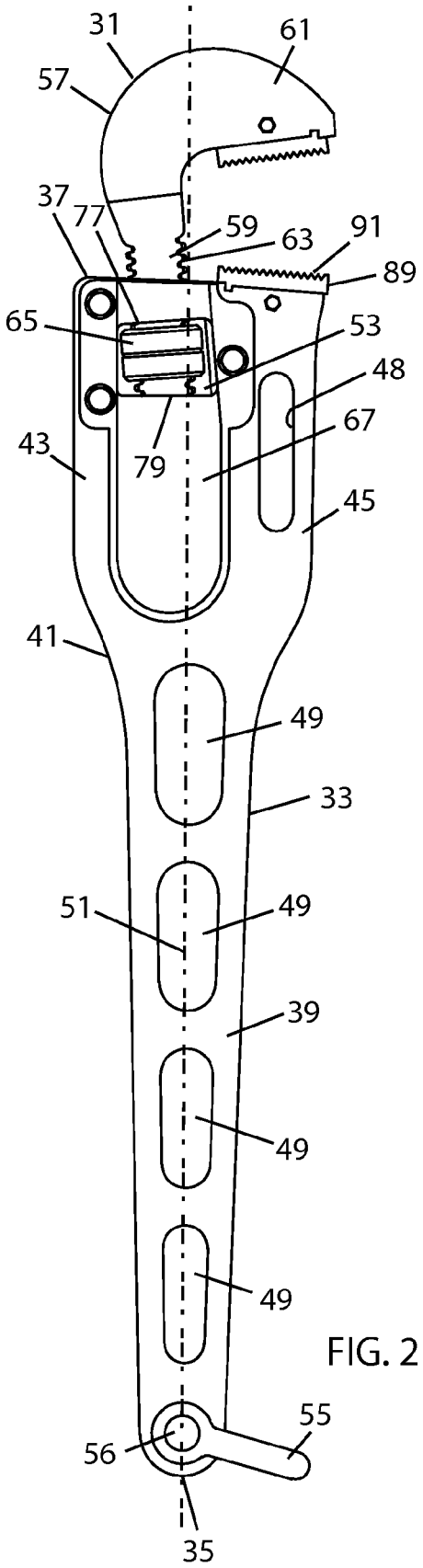
FIG. 2 is a side view of a safety pipe wrench according to an embodiment of the present invention.
Figure 3:
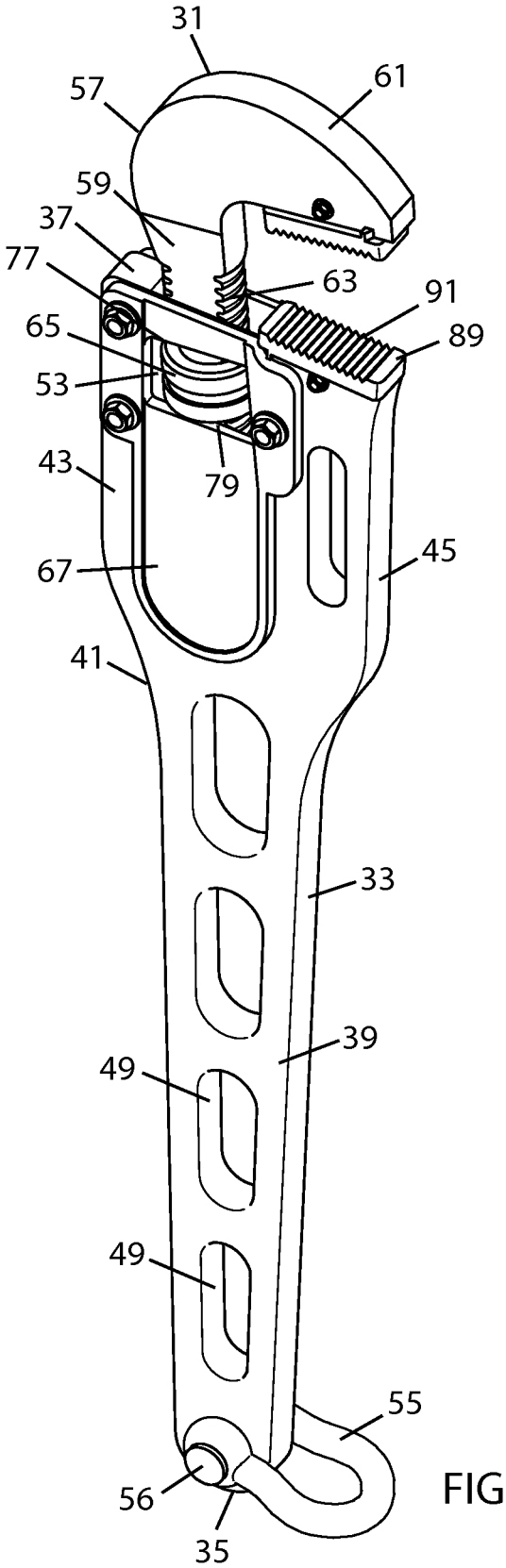
FIG. 3 is a perspective view of the safety pipe wrench of FIG. 2.

FIG. 2 is a side view of a safety pipe wrench 31 according to an embodiment of the present invention. FIG. 3 is a perspective view of the same pipe wrench. Referring to FIG. 2 or 3, the pipe wrench 31 has a flat, Y-shaped handle 33 with a bottom end 35 and a top end 37. The terms "top" and "bottom" are relative to the orientation of the drawing shown in FIG. 2. The Y-shaped handle 33 has a stem 39, which extends from the bottom end 35 towards the top end 37. The stem 39 bifurcates at a location 41 between the bottom end 35 and top end 37 into a left arm 43 and a right arm 45. The terms "left" and "right" are relative to the orientation of the drawing shown in FIG. 2. The left arm 43 and right arm 45 extend along parallel paths to the top end 37 of the handle 33. The stem 39, left arm 43, and right arm 45 form a Y-shape, hence the term "Y-shaped handle." The left arm 43 and right arm 45 provide parallel load paths, as opposed to the cantilever load path of a traditional handle such as shown at 10 in FIG. 1. The Y-shaped handle 33 is made of a ductile and malleable metal or alloy. A suitable material is high-strength aluminum alloy such as used in the aircraft industry. The aluminum alloy may be anodized.

Multiple slots 49 are formed in the stem 39. The slots 49 are spaced apart along a longitudinal axis 51 of the handle 33. The longitudinal axis 51 is a median line running from the bottom end 35 of the handle 33 the top end 37 of the handle 33. The slots 49 may have the same or different cross-sectional areas. In the drawing of FIG. 2, the cross-sectional areas of the slots 49 are increasing along the longitudinal axis 51, from the bottom end 35 towards the location 41 at which the stem 39 bifurcates into the left arm 43 and right arm 45. The slots 49 in the stem 39 serve at least two purposes. The first purpose is to reduce the weight of the stem 49 or the amount of material used in making the stem 49. The second purpose is to disrupt crack propagation across the width of the stem 49 (width is measured transverse to the longitudinal axis 51). For illustration purposes, if a crack starts in the stem 49, the crack will most likely start at a thinner section of the stem adjacent to one of the slots 49. Such a crack will not be able to propagate across the width of the stem 49 because the slot 49 near the crack would disrupt propagation the crack. The slots 49 and the ductile material used in making the handle 33 help avoid the case of flying handles when the safety pipe wrench 31 is used to make up high torque connections.

The left arm 43 and right arm 45 are spaced apart so that a slot 53 is defined between them. The slot 53 is open at the top end 37 of the handle 33. The width of the left arm 43 is different from that of the right arm 45 so that the slot 53 is eccentric relative to the longitudinal axis 51 of the handle 33 (width is measured transverse to the longitudinal axis 51). The slot 53 is also eccentric relative to the slots 49 in the stem 39. However, in alternate embodiments, the slot 53 may not be eccentric relative to the longitudinal axis 51 and slots 49, and the width of the left arm 43 and right arm 45 may be roughly equal.

A shackle 55 is attached to the bottom end 35 of the handle 33. The shackle 55 can be used to couple the handle 33 to a machine such as an overhead crane. The shackle 55 is attached to the bottom end 35 of the handle by inserting an adjustable lock 56 into aligned holes (not visible in the drawing) in the shackle 55 and bottom end 35 of the handle 33. The hole in the handle 33 (through which the adjustable lock 56 is inserted) may be profiled to achieve low stress. The shackle 55 is made of a ductile and malleable material. A suitable example is high-strength alloy steel such as 4340 alloy steel.

A jaw 57 has a shank 59 terminating in a jaw head 61. The jaw 57 is made of a ductile and malleable material. A suitable example is high-strength alloy steel such as 4340 alloy steel. Teeth or threads 63 are formed on opposite sides of the shank 59. The shank 59 is inserted into a bore of a nut 65. (The nut 65 includes cylindrical body with a bore.) The bore of the nut 65 is threaded so that the nut 65 can engage the shank 59 and also rotate relative to the shank 59. The nut 65, with the shank 59 extending through its bore, is disposed in the slot 53. The bore of the nut 65 is in an upright orientation (relative to the orientation of the drawing in FIG. 2) so that it is accessible from the top end 37 of the handle 33 or so that the shank 59 extends out of the slot 53 through the top end 37 of the handle 33. As the nut 65 is rotated, the shank 59 moves relative to the nut 65, where the rotational direction of the nut 65 determines whether the shank 59 is extended or retracted relative to the slot 53.

The nut 65 and the shank 59 are retained in the slot 53 by two side plates (or surfaces) 67, 69. The side plate 67 is attached to the left arm 43 and the right arm 45 and from the front side 71 of the handle 33. The side plate 69 is attached to the left arm 43 and the right arm 45 from the backside of the handle 33 (the backside is in opposing relation to the front side 71). Again, the terms "front side" and "backside" are relative to the orientation of the drawing in FIG. 2. The side plates 67, 69 have windows 73 (the window for the side plate 69 is not visible in the drawing but is in opposing relation to the window of the side plate 67) through which the nut 65 in the slot 53 can be accessed. The nut 65 juts into the windows 73 and is encompassed and constrained by the windows 73. To explain further, the thickness of the side plate 67 at a top wall 77 of the window 73 serves as a top stop for the nut 65. The thickness of the side plate 67 at the bottom wall 79 of the window 73 serves as a bottom stop for the nut 65. The width of the window 73, i.e., the distance between the sidewalls 81, 83 of the window 73, is smaller than the diameter of the nut 65 so that the nut 65 cannot fall through the window 73. The preceding explanation about how the window 73 in the side plate 67 encompasses and constrains the nut 65 is also applicable to the side plate 69. The portions of the side plates 67, 69 below the windows 73 also constrain the shank 59 in the slot 53.

Figure 4:
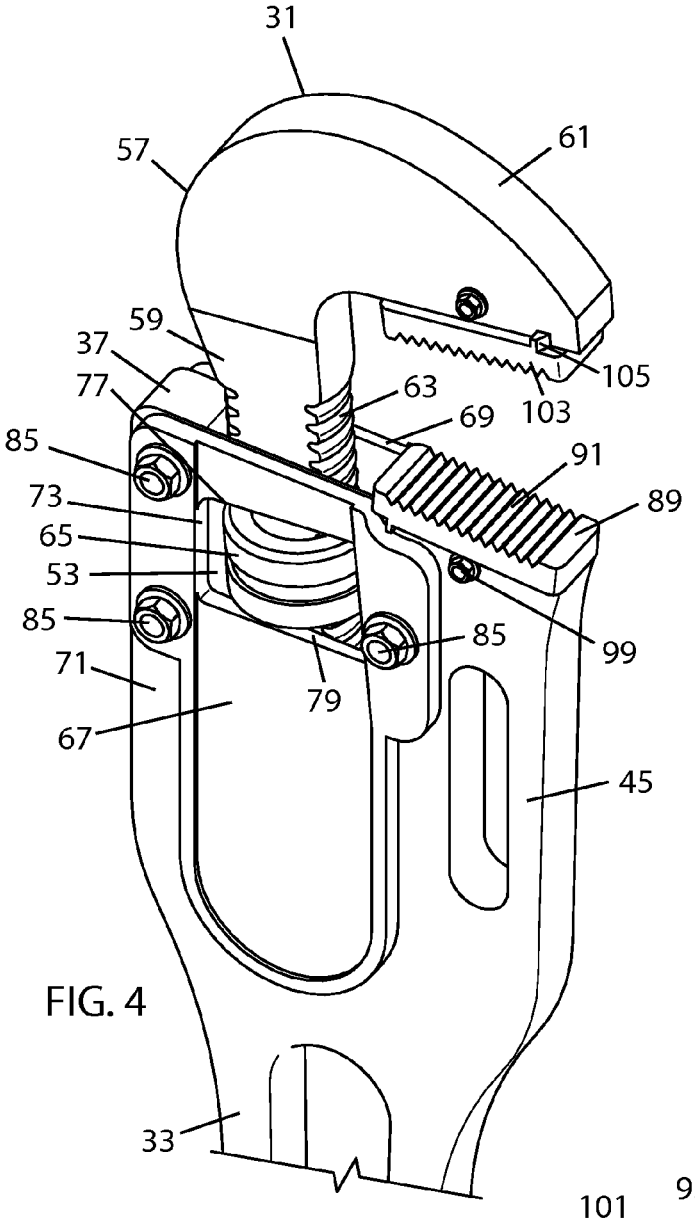
FIG. 4 is a close-up view of a portion of the safety pipe wrench of FIG. 2.

Each of the side plates 67, 69 is attached to both the left arm 43 and the right arm 45. In FIG. 4, the side plate 67 is attached to the left arm 43 and the right arm 45 at a total of three points, where the three points are not all on a line or are not all collinear. Additional attachment points between the side plate 67 and the arms 43, 45 may be provided. In FIG. 4, the bolts 85 represent the attachment points between the side plate 67 and the arms 43, 45. The bolts 85 include threads for engaging the arms 43, 45, but other fasteners besides bolts could be used for the attachment points. One bolt 85 is used between the side plate 67 and the right arm 45, and two bolts 85 are used between the side plate 67 and the left arm 43. The single attachment point between the right arm 45 and the side plate 67 serves as a slight hinge to transfer load to the left arm 43. The explanation above about attachment of the side plate 67 to the arms 43, 45 is equally applicable to the attachment of the side plate 69 to the arms 43, 45. The side plates 67, 69 are made of a ductile and malleable metal or alloy. A suitable example is high-strength alloy steel such as A514 alloy steel. The side plates 67, 69 may be provided as separate parts. Alternatively, the side plates 67, 69 may be provided as a single part. The single part would include surfaces that correspond to the side plates and a bridge surface connecting the surfaces. The bridge surface could sit on the top end 37 of the handle 33 with the surfaces that correspond to the side plates depending downwardly from the bridge.

Figure 5:
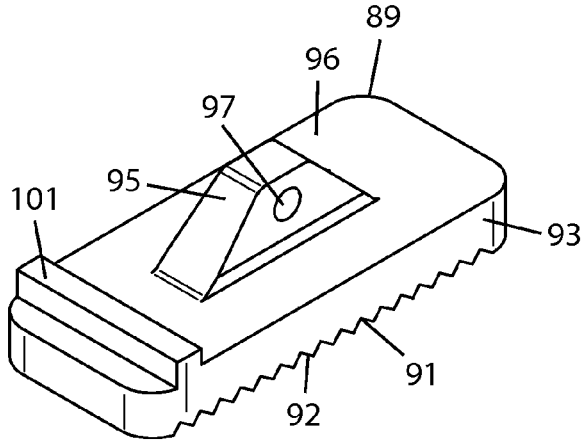
FIG. 5 is a perspective view of a gripping insert.

A gripping insert 89 is mounted on the right arm 45. Any of a variety of gripping inserts may be mounted on the right arm 45. FIG. 5 is a perspective of the particular gripping insert 89 shown in FIGS. 2-4. The gripping insert 89 includes teeth 91 formed on a front face 92 of an insert body 93. The teeth 91 are for gripping an object, such as a pipe. A ridge 95 is formed on the backside 96 of the insert body 93. A hole 97 is formed in the ridge 95. A corresponding slot is formed at the top end of the right arm to receive the ridge 95 (the right arm is shown at 45 in FIG. 4, and the top end of the right arm is the surface of the right arm on which the gripping insert 89 is mounted). When the gripping insert 89 is mounted on the right arm (45 in FIG. 4), the hole 97 in the ridge 95 is aligned with holes in the right arm, and a bolt (99 in FIG. 4) is inserted into these aligned holes and secured in place via a nut (the holes in the right arm are not visible, but one of the holes would be where the bolt 99 is shown in FIG. 4). A key 101 is also formed on the backside 96 of the gripping insert 89. The key 101 is an elongated bar. The key 101 fits into another slot at the top end of the right arm (45 in FIG. 4) when the gripping insert 89 is mounted on the right arm. In the embodiment shown in FIG. 5, the key 101 is integrally formed with the insert body 93. However, it is possible to also provide the key 101 as a separate component that will be inserted in between the insert body 93 and the top end of the right arm (45 in FIG. 4). The key 101 helps distribute load applied between the gripping insert 89 and the top end of the right arm (45 in FIG. 4). The gripping insert 89 may be made of a ductile and malleable material, such as hardened alloy steel.

Returning to FIG. 4, the jaw head 61 is located above the top end 37 of the handle 33. A gripping insert 103 is mounted on the jaw head 61. When the pipe wrench 31 is assembled for use, the position of the jaw head 61 is such that the gripping insert 103 on the jaw head 61 is opposite to the gripping insert 89 on the right arm 45. The opposed gripping inserts 89, 103 can cooperatively grip an object of interest. The nut 65 can be rotated to extend or retract the shank 59 from or into the slot 53, respectively, in order to adjust the distance between the opposed gripping inserts 89, 103—the distance between the gripping inserts 89, 103 increases as the shank 59 is extended and decreases as the shank 59 is retracted. As in the case of the right arm 45, any of a variety of gripping inserts may be mounted on the jaw head 61. For illustration purposes, the gripping insert 103 may be the same as the gripping insert 89 shown in FIG. 5 and explained above. To accommodate the gripping insert 103, suitable slots are formed in the jaw head 61 to receive the ridge (hidden behind the gripping insert 103) and key 105. The key 105 may or may not be integrally formed with the gripping insert 103 but is embedded in the end face of the jaw head (i.e., the face of the jaw head in contact with the backside of the gripping insert 103) and serves the same purpose as described above for the key 101.

Other types of gripping inserts and method of mounting the gripping inserts are known in the art and can be used in place of the gripping insert described in FIG. 5. See, for example, U.S. Pat. No. 2,656,751 (issued to W. J. Johnson et al.), which discloses jaw inserts with dovetail mortises and corresponding dovetail tenons formed in jaws to engage with the dovetail mortises.

Referring to FIG. 2, a slot 48 formed in the right arm 45 provides a pick-up point for the handle 33. The pick-up point allows an operator to easily pick up the wrench 31 one-handed while the wrench 31 is attached to an overhead crane or other overhead device. The pick-up point provided by the slot 48 is properly balanced so that the shackle 55 tends to fall lower than the jaw head 61 in order to allow the jaw head 61 to grip an object while the operator holds onto the wrench 31 with one hand and controls the crane with the other hand.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A safety pipe wrench comprising:

a V-shaped handle having a stem extending from a first end of the handle towards a second end of the handle, the stem bifurcating into a first arm and a second arm at a location between the first end and the second of the handle, the first arm and the second arm extending to the second end of the handle, a terminal free end of the second arm defining in part said second end of the handle, a slot being defined between the first arm and the second arm;

a first gripping insert mounted on the first arm, the first gripping insert and the first arm immovable relative to the handle;

a nut rotatably retained in the slot;

a jaw consisting of a shank terminating in a single jaw head, the shank being movably engaged with the nut, a second gripping insert mounted on the single jaw head; and wherein a width of the first arm is greater than a width of the second arm so that the slot defined between the first arm and the second arm is eccentric relative to a longitudinal axis of the handle.

2. The safety pipe wrench of claim 1, further comprising a retention member coupled to the first and second arms for retaining the nut in the slot.

3. The safety pipe wrench of claim 2, wherein the retention member comprises a first surface adjacent to the first arm and the second arm on a first side of the handle and a second surface adjacent to the first arm and the second arm on a second side of the handle.

4. The safety pipe wrench of claim 3, wherein a first window is formed in the first surface and a second window is formed in the second surface.

5. The safety pipe wrench of claim 4, wherein each of the first and second windows encompasses and constrains the nut.

6. The safety pipe wrench of claim 3, wherein the first surface is attached to the first and second arms at a total of at least three points, the three points being non-collinear.

7. The safety pipe wrench of claim 6, wherein the second surface is attached to the first and second arms at a total of at least three points, the three points being non-collinear.

8. The safety pipe wrench of claim 3, wherein the first surface is attached to the first arm at a single point and the second surface is attached to the second arm at a single point.

9. The safety pipe wrench of claim 3, wherein the first surface is attached to the first arm at a single point and is attached to the second arm at a two points.

10. The safety pipe wrench of claim 9, wherein the second surface is attached to the first arm at a single point and is attached to the second arm at a two points, further comprising an elongated slot formed in at least one of the first and second arms, the slot providing a pick-up point for the Y-shaped handle.

11. The safety pipe wrench of claim 2, wherein the handle, jaw, gripping inserts, nut, and retention member are each made of a ductile and malleable material.

12. The safety pipe wrench of claim 11, wherein the handle is made of a high-strength aluminum alloy and the jaw, gripping inserts, nut, and retention member are made of a high-strength alloy steel.

13. The safety pipe wrench of claim 1, further comprising a plurality of elongated slots formed in the stem along a longitudinal axis of the handle.

14. The safety pipe wrench of claim 1, further comprising a first load distribution key being an elongated bar disposed between a backside of the first gripping insert and an end face of the jaw head.

15. The safety pipe wrench of claim 14, wherein the first load distribution key is integrally formed with the backside of the first gripping insert and is adapted for embedding on the end face of the jaw head.

16. The safety pipe wrench of claim 1, further comprising a second load distribution key being an elongated bar disposed between a backside of the second gripping insert and an end face of the first arm.

17. The safety pipe wrench of claim 16, wherein the second load distribution key is integrally formed with the backside of the second gripping insert and is adapted for embedding on the end face of the first arm.

18. The safety pipe wrench of claim 1, wherein the first gripping insert and the second gripping insert have teeth.

19. The safety pipe wrench of claim 1, further comprising a shackle coupled to the first end of the handle for attachment of the handle to an overhead device.

20. The safety pipe wrench of claim 1, wherein the second gripping insert is in opposing relation to the first gripping insert to allow the first and second gripping inserts to cooperatively grip an object.

21. The safety pipe wrench of claim 1, further comprising a pair of side plates positionable about the slot and enclosing the shank therein.

22. The safety pipe wrench of claim 21, wherein the pair of side plates rotatably support the nut such that the nut is rotatable about its axis to act as a hinge for the jaw.

23. A safety pipe wrench comprising:

a V-shaped handle having a stem extending from a first end of the handle towards a second end of the handle, the stem bifurcating into a first arm and a second arm at a location between the first end and the second of the handle, the first arm and the second arm extending to the second end of the handle, a terminal free end of the second arm defining in part said second end of the handle, a slot being defined between the first arm and the second arm;

a first gripping insert mounted on the first arm;

a nut rotatably retained in the slot;

a jaw consisting of a shank terminating in a single jaw head, the shank being movably engaged with the nut, a second gripping insert mounted on the single jaw head;

a pair of side plates positionable about the slot and enclosing a free end of the shank therein; and wherein a width of the first arm is greater than a width of the second arm so that the slot defined between the first arm and the second arm is eccentric relative to a longitudinal axis of the handle.

* * * * *